United States Patent [19]

Cancilla

[11] 4,048,800

[45] Sept. 20, 1977

[54] HYDRAULIC JACK HAVING ROTATING PUMP HANDLE

[76] Inventor: Philip S. Cancilla, 342 Ann Darling Drive, San Jose, Calif. 95133

[21] Appl. No.: 595,866

[22] Filed: July 14, 1975

[51] Int. Cl.[2] ..... F15B 15/18

[52] U.S. Cl. ..... 60/477; 60/482; 254/93 H; 254/DIG. 3; 417/903; 74/543

[58] Field of Search ..... 60/477, 479, 481, 482; 254/93 H, DIG. 3, 93 R; 417/903; 74/543, 504

[56] References Cited

U.S. PATENT DOCUMENTS

| | | | |
|---|---|---|---|
| 2,328,483 | 8/1943 | Nilson | 60/479 |
| 2,828,611 | 4/1958 | Johansson et al. | 60/481 |
| 2,835,541 | 5/1958 | Rhoads | 60/481 X |

FOREIGN PATENT DOCUMENTS

| | | | |
|---|---|---|---|
| 142,531 | 10/1953 | Sweden | 60/477 |

*Primary Examiner*—Edgar W. Geoghegan
*Attorney, Agent, or Firm*—John J. Leavitt

[57] ABSTRACT

Presented is a hydraulic jack structure having a pump assembly in connection with which is rotatably mounted a pump handle assembly which may be rotated in a horizontal plane through about 320° to permit selective positioning of the handle during a pumping operation.

2 Claims, 2 Drawing Figures

HYDRAULIC JACK HAVING ROTATING PUMP HANDLE

BACKGROUND OF THE INVENTION

1. Field of the Invention

This invention relates to hand-actuated hydraulic power units, and more particularly to hand-actuated hydraulic jack structures of the type used to lift heavy weights such as automobiles and motorcycles.

2. Description of the Prior Art

One of the problems encountered in the use of a conventional hydraulic jack is that once placed for use and a weight is lifted, the jack structure cannot be moved, and since the pump assembly and pump handle assembly are fixed in position on the jack structure, the handle assembly cannot be moved at all to avoid an obstruction to pumping action of the handle, or the handle assembly can be repositioned only laboriously and only to a limited degree. Such a jack structure is depicted in U.S. Pat. No. 3,806,091 issued Apr. 23, 1974. Accordingly, it is one of the principal objects of the invention to provide a hydraulic jack structure in which the handle assembly may be rotated in a horizontal plane through an arc of about 320° in relation to the associated jack structure without interrupting the pumping action.

A search of the prior art has failed to reveal a pump handle assembly that can be manufactured as a universally applicable kit for application to existing hydraulic jacks and other hydraulic power units. Accordingly, another object of the invention is to provide such a kit.

Many patents in the prior art teach the concept of detachability or flexibility between the hydraulic lifting unit or power unit and the hydraulic pump assembly. Examples of such patents include U.S. Pat. Nos. 2,927,769 and 3,081,066. Surprisingly, however, despite a diligent search, prior art patents have not been found which teach the concept of flexibility or reorientation of the pump handle assembly in relation to the pump assembly in a hydraulic power unit. Accordingly, still another object of the invention is to provide a hydraulic jack structure that incorporates this concept.

In an effort to accomplish the same purpose as the present invention, some portable hydraulic jack structures are provided with a fluid reservoir and pump assembly which as a whole unit rotates about a horizontal axis. Such a structure is taught in U.S. Pat. No. 3,370,421. Accordingly, it is another object of the invention to provide a pump assembly and pump handle assembly for a hydraulic jack structure in which the pump handle assembly rotates about a vertical axis in relation to the pump assembly.

Other patents, such as U.S. Pat. Nos. 3,286,985 and 2,903,238 teach devices in which the entire jack structure rotates in relation to the load imposed thereon. Accordingly, a still further object of the present invention is the provision of a jack structure in which only the pump handle assembly rotates in a horizontal plane in relation to the jack structure.

The invention possesses other objects and features of advantage, some of which, with the foregoing, will be apparent from the following description and the drawings. It is to be understood however that the invention is not limited to the embodiment illustrated, since it may be embodied in various forms within the scope of the appended claims.

SUMMARY OF THE INVENTION

In terms of broad inclusion, the hydraulic jack structure of the invention includes a power unit comprising a cylinder having a ram therewithin adapted to be moved in one direction by the application of hydraulic pressure on one end of the ram, and actuated in the opposite direction by an external force applied to the opposite end of the ram to drive it back into the cylinder. A reservoir for fluid is provided, connected to a pump chamber by a passageway including a by-pass valve for releasing the hydraulic pressure. A pump assembly is associated with the pump chamber and includes a cylinder having a pump shaft therewithin adapted to be axially reciprocated to effect a pumping action. A handle assembly is rotatably mounted on the pump cylinder and connected to the pump shaft so as to permit rotation of the handle assembly in a horizontal plane through an arc of about 320° even while pumping action is taking place and without interrupting such pumping action.

DESCRIPTION OF THE PREFERRED EMBODIMENT

Figure 1:
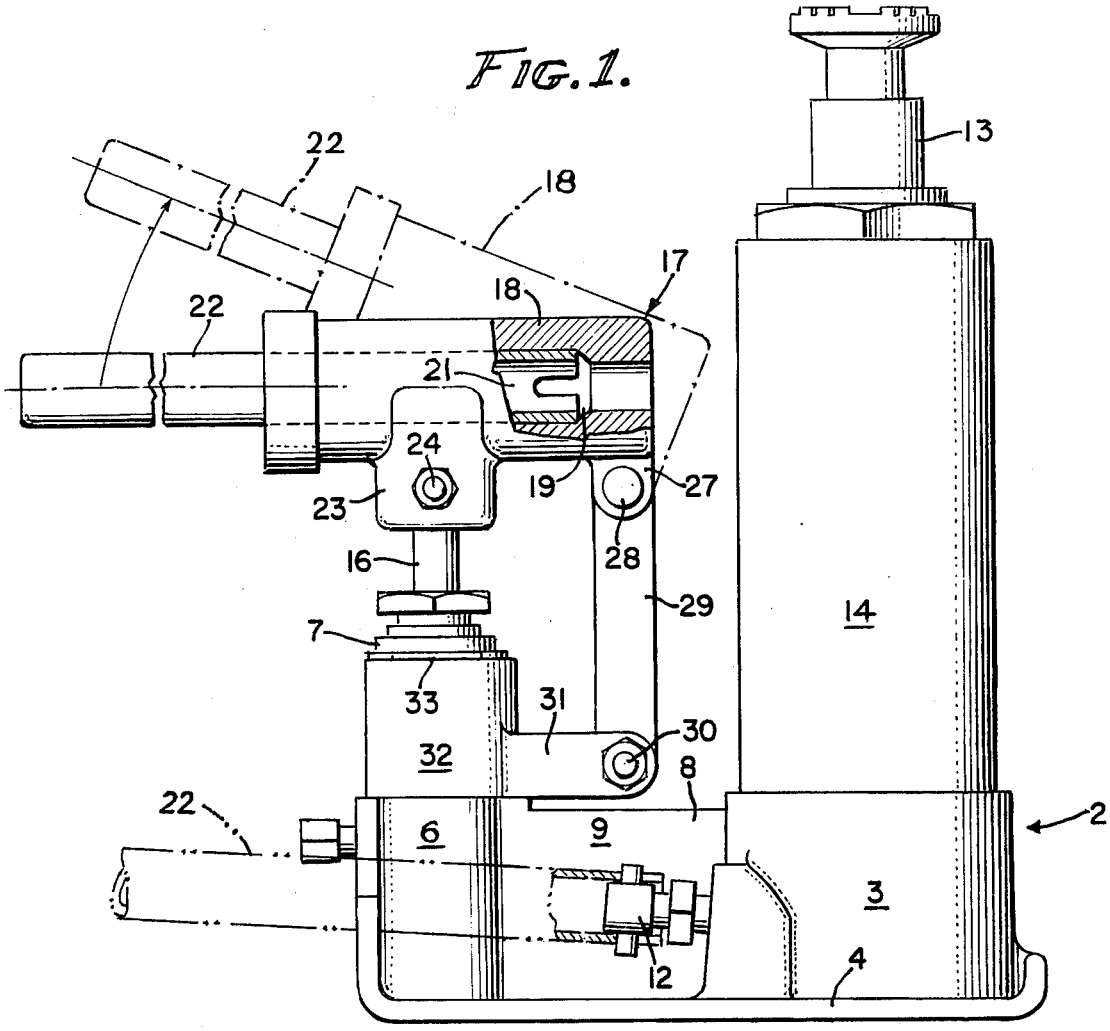
FIG. 1 is a side elevational view partly in vertical section showing a portable hydraulic jack incorporating a rotatable pump handle assembly in accordance with this invention. Pivotal actuation of the pump handle assembly in a vertical plane such as when the jack is actuated is shown in broken lines.

In terms of greater detail, the hydraulic jack structure of the invention comprises a base designated generally by the numeral 2, and includes a cylindrical portion 3 formed integrally with a bottom plate 4 which is also integral with a hydraulic pump cylinder 6 which projects upwardly in a portion 7 above the top edge 8 of a gusset or rib 9 that connects integrally between the cylindrical portion 3 and the pump cylinder 6. The jack is also provided with the conventional relief valve 12 which controls passage of hydraulic fluid through a by-pass (not shown) between the bottom of the ram 13 and the fluid reservoir contained in the cylindrical portion 3 and rib 9 in a conventional manner. The ram 13 operates in a conventional manner within cylinder 14, and fluid from the reservoir bleeds into the pump chamber within pump cylinder 6, where actuation of pump shaft 16 in a reciprocating motion imposes pressure on the fluid and forces it into the cylinder 14 below the ram 13, thus causing the ram to be projected from the power cylinder 14. All of the foregoing structure is conventional and no claim is made thereto apart from its combination with the novel rotatable pump handle assembly which will now be described.

Referring to FIG. 1, there is provided a pump handle assembly designated generally by the numeral 17, and including a generally cylindrical elongated body 18 forming a cylindrical socket 19 for receiving snugly one end 21 of an elongated handle 22. The body is formed with integral bearing lugs 23, pivotally connected by a hardened pivot pin 24 with the upper end portion of pump shaft 16. It should be noted that the bearing lugs are positioned intermediate the ends of the elongated body, and that the axis of the pivot pin 24 lies perpendicular to the longitudinal axis of the elongated body 18 and the axes of main and pump cylinders 14.

Formed on one end 26 of the elongated body 18 and projecting in the same direction as the lugs 23, is a second pair of lugs 27. These lugs form a bearing for a pivot pin 28 which pivotally attaches the end of the body 18 to an elongated and depending link 29 which, at its end opposite the pivot pin 28, is pivotally connected by a pivot pin 30 to a pair of spaced lugs 31 formed integrally on and projecting radially from the outer periphery of a collet 32 rotatably mounted on the cylindrical pump cylinder portion 7. The collet is retained thereon against longitudinal displacement in one direction by a split spring ring 33.

It will thus be seen that the pivot pins 24 and 28 lie in a common horizontal plane when the handle assembly is in the position indicated in solid lines in FIG. 1, which may be considered an intermediate position between upper and lower extremes. In this position the link 29 is generally parallel to the vertical axis of the pump shaft 16. Thus, when the handle 22 is actuated in a vertical plane to raise the pump shaft 16 as shown in broken lines in FIG. 1, the link 29 is placed in compression and a clockwise-directed force is imposed on the lugs 31, which do not move because of their integral connection to the collet 32. When the handle is forced downwardly, the pump shaft 16 forces fluid before it, thus causing the link 29 to be placed in tension. Such actuation of the handle effects pumping action of the pump and causes the ram 13 to be forced from the cylinder 14.

Figure 2:
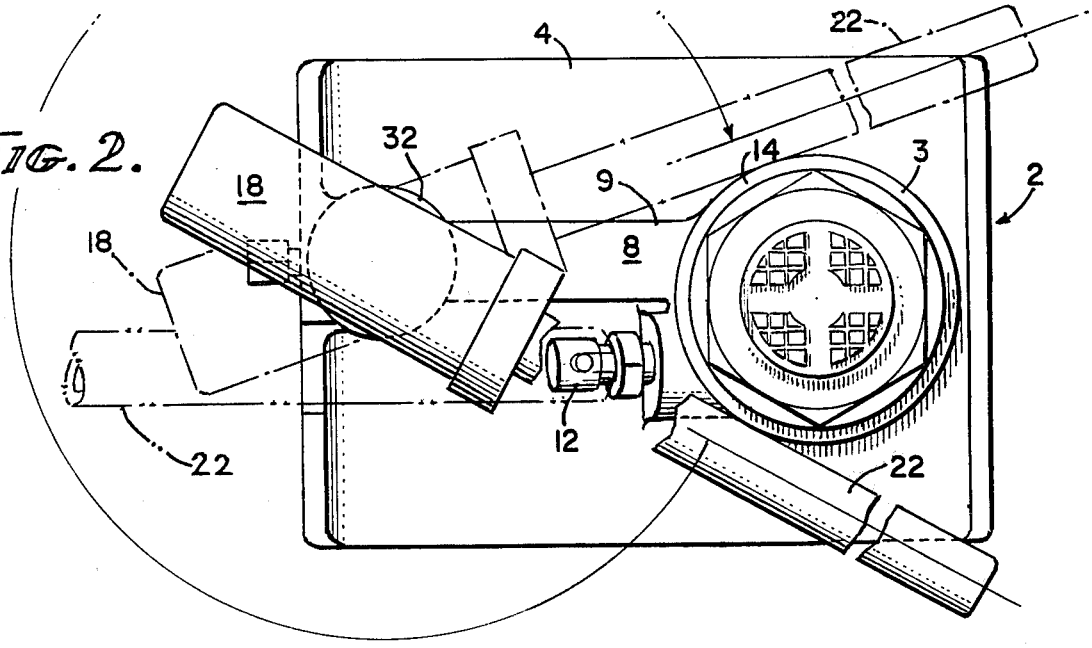
FIG. 2 is a plan view of the jack structure illustrated in FIG. 1, a portion of the handle being broken away, and rotation of the pump handle assembly in a horizontal plane through about 320° being shown by displacement of the handle assembly from the full-line position to the broken-line positions.

It frequently happens that a portable jack must be used in such close quarters that the jack handle cannot conveniently be manipulated. To obviate this difficulty, the handle assembly 17 may be rotated about the longitudinal axis of the pump shaft by merely imposing a horizontally directed force on the handle assembly. When this is done, the elongated body 18 imposes a rotative force on the pump shaft and causes the collet 32 to rotate with it in a horizontal plane about the axis of the pump shaft by virtue of the pivotal interconnection between the elongated body and the collet afforded by the link 29. The link 29 also rotates about the pump shaft, so that the handle assembly may be selectively repositioned in any position within the approximately 320° arc illustrated in FIG. 2.

It should be understood that while the invention has been described with reference to a portable hydraulic jack structure, it may be applied with advantage to many other hydraulic power units where flexibility and adjustability is required between the hydraulic pump assembly and the handle assembly.

Having thus described the invention, what is claimed and sought to be protected by letters patent of the United States is as follows:

1. In combination with a hydraulic jack structure having a main cylinder symmetrical about a longitudinal axis and a ram movable therewithin by hydraulic fluid and a pump assembly including a pump cylinder and a pump shaft symmetrical about a longitudinal axis and axially displaceable therewithin to pump fluid from within said pump cylinder into said main cylinder by axial displacement of said pump shaft, a pump handle assembly, comprising:

a. an elongated body having a socket therein adapted to receive a handle and pivotally connected to said pump shaft;

b. link means pivotally connected at one of its ends to said elongated body; and c. means providing horizontal rotation of said pump handle, said means including parallel longitudinal axes of said main cylinder and said pump cylinder and further including means rotatably mounted on said pump cylinder in coaxial relation with said pump shaft and pivotally connected to the other end of said link means whereby said pump handle assembly may be pivoted in an horizontal plane perpendicular to said parallel axes of said main and pump cylinders through about 320° about the axis of said pump shaft and cylinder to selectively position the elongated body in relation to the main cylinder to avoid obstruction of pumping action of a handle in said socket in said elongated body.

2. The combination according to claim 1, in which said means rotatably mounted on said pump cylinder comprises a collet restrained against axial displacement on the pump cylinder.

* * * * *